US012486767B2

(12) United States Patent
Dimitroff

(10) Patent No.: US 12,486,767 B2
(45) Date of Patent: Dec. 2, 2025

(54) EXCAVATION AND SHORING EQUIPMENT

(71) Applicant: Ted R. Dimitroff, Columbia, MO (US)

(72) Inventor: Ted R. Dimitroff, Columbia, MO (US)

( * ) Notice: Subject to any disclaimer, the term of this patent is extended or adjusted under 35 U.S.C. 154(b) by 0 days.

(21) Appl. No.: 18/603,846

(22) Filed: Mar. 13, 2024

(65) Prior Publication Data

US 2024/0209692 A1 Jun. 27, 2024

Related U.S. Application Data

(62) Division of application No. 17/932,797, filed on Sep. 16, 2022, now Pat. No. 11,988,044.

(51) Int. Cl.

| | |
|---|---|
| ***E21D 5/01*** | (2006.01) |
| ***E21B 33/14*** | (2006.01) |
| *E21B 10/26* | (2006.01) |

(52) U.S. Cl.
CPC ..... *E21D 5/01* (2013.01); *E21B 33/14* (2013.01); *E21B 10/26* (2013.01)

(58) Field of Classification Search
CPC ..... E21D 5/01; E21B 33/14; E21B 10/26
See application file for complete search history.

(56) References Cited

U.S. PATENT DOCUMENTS

| | | | | |
|---|---|---|---|---|
| 5,017,016 | A | 5/1991 | Nasu | |
| 5,167,719 | A | 12/1992 | Tamaki | |
| 5,176,212 | A | 1/1993 | Tandberg | |
| 5,823,276 | A | 10/1998 | Beck, III | |
| 8,926,229 | B1 * | 1/2015 | Clair | E02D 17/08 405/282 |
| 9,255,476 | B2 | 2/2016 | Mancini et al. | |
| 2006/0196699 | A1 | 9/2006 | Estes et al. | |
| 2010/0209199 | A1 * | 8/2010 | Pogue | E02D 17/08 405/282 |

(Continued)

FOREIGN PATENT DOCUMENTS

| | | | |
|---|---|---|---|
| CN | 103615253 A | * | 3/2014 |
| CN | 114753770 A | | 7/2022 |

(Continued)

OTHER PUBLICATIONS

Das, Madhurima, "Cylinder: Shape, Definition, Types, Forumlas, Properties—Embibe" Oct. 26, 2023, www.embibe.com/exams/cylinder. (Year: 2023) 2023.

(Continued)

*Primary Examiner* — Caroline N Butcher
(74) *Attorney, Agent, or Firm* — McKee, Voorhees & Sease, PLC

(57) ABSTRACT

A reaming tool forms a hole in the ground with a sidewall and a floor, and a deepened channel around the perimeter of the floor adjacent to sidewall. Fluid is provided during excavation to form a slurry to hold the sidewall and prevent cave-in of material into the hole. After the hole reaches a desired depth, the reaming tool is removed, and a shoring wall is inserted into the hole through the slurry and seated in the perimeter edge channel. The shoring wall includes vertical tubes for connection to a dewatering machine. Then, the slurry can be vacuumed from the hole, while the dewatering machine keeps the empty hole as dry as possible. Extending the shoring wall into the channel beyond the floor of the hole helps seal flow of water from entering the hole.

14 Claims, 5 Drawing Sheets

(56) References Cited

U.S. PATENT DOCUMENTS

| | | | |
|---|---|---|---|
| 2011/0299941 | A1 | 12/2011 | Dimitroff |
| 2012/0219363 | A1 | 8/2012 | Dimitroff |
| 2013/0228382 | A1 | 9/2013 | Sauvageau |

FOREIGN PATENT DOCUMENTS

| | | | |
|---|---|---|---|
| DE | 3735008 | A1 | 5/1989 |
| DE | 9115823 | U1 | 2/1992 |
| DE | 9207366 | U1 | 8/1992 |
| DE | 4142222 | A1 | 6/1993 |
| DE | 4109691 | C2 | 1/1994 |
| EP | 377087 | A2 | 7/1990 |
| EP | 351440 | B1 | 12/1992 |
| JP | 2705803 | B2 | 1/1998 |
| JP | 4147237 | B2 | 9/2008 |

OTHER PUBLICATIONS

Welker et al., "Evaluation of a Commercial Vacuum System for the Removal of Asbestos," EPA Research and Development, EPA-600/2-80-088, 85 pages, May 1980.

* cited by examiner

EXCAVATION AND SHORING EQUIPMENT

CROSS-REFERENCE TO RELATED APPLICATIONS

This application is a Divisional application of nonprovisional application U.S. Ser. No. 17/932,797, filed on Sep. 16, 2022, which is herein incorporated by reference in its entirety.

TECHNICAL FIELD

The invention relates to equipment and methodology for creating and maintaining an excavated hole in the ground.

BACKGROUND

The excavation of material to form a hole or pit in the ground, such as to provide an in-the-ground work area, can be done in many ways. Depending on soil conditions, the excavated hole may require shoring to prevent material from caving into the open hole and to maintain the sidewall of the hole. For example, if the soil is dry and loose, or very wet, the hole sidewall will not stand on its own, such that shoring is required to hold the sidewall in place. Some existing methods require the ground or soil to be dewatered prior to excavation. In other instances, the shoring structure must be installed as the soil is excavated, until the hole or pit reaches a desired depth. These current methods have problems with the soil, sand or water falling into the excavated area. Another alternative method, though expensive, is to drive sheet piling steel into the ground before excavation, and then excavating the soil or sand.

Accordingly, a primary objective of the present invention is the provision of a method for improved excavation and shoring of a hole or pit in the ground.

Another objective of the present invention is the provision of equipment to simplify the excavation and shoring of a hole in the ground.

A further objective of the present invention is the provision of an excavation reaming tool to form a pit in the ground having a deeper perimeter edge than the floor of the pit.

Still another objective of the present invention is the provision of a shoring structure having tubes for connection to a dewatering machine.

Another objective of the present invention is the provision of a method of excavating a hole with a reaming tool and the use of slurry to maintain the sidewall of the excavated hole, prior to installation of a shoring ring.

These and other objectives will become apparent from the following description of the invention.

SUMMARY

The method of the present invention for excavating and shoring a hole in the ground utilizes an innovative reaming tool and shoring ring to simplify the process and avoid problems of prior art processes for excavation and shoring.

The method includes drilling a hole in the ground having a sidewall, a floor at a first depth, and the perimeter edge around the hole at a second depth deeper than the floor. Water is provided during excavation so as to create a slurry to help hold back the sidewall as the hole is formed. Then, a shoring ring is installed in the excavated hole so as to sit downwardly into the deepened perimeter edge. The slurry can then be vacuumed out of the hole. The shoring ring includes internal vertical tubes, which can be connected to a conventional dewatering machine so to further suck moisture out of the excavated hole and from the surrounding soil.

The reaming tool for excavating the hole is generally circular in shape and is driven by a driveshaft which rotates and forces the tool downwardly as cutting tips on the reamer head bore through the soil material. The perimeter edge of the reaming head includes legs with cutting tips to form the deepened perimeter edge of the hole. The shoring ring includes inner and outer walls, with a plurality of vertical tubes residing between the inner and outer walls. The upper ends of the tubes are adapted to be connected to hoses of a dewatering machine.

DETAILED DESCRIPTION

Figure 2:
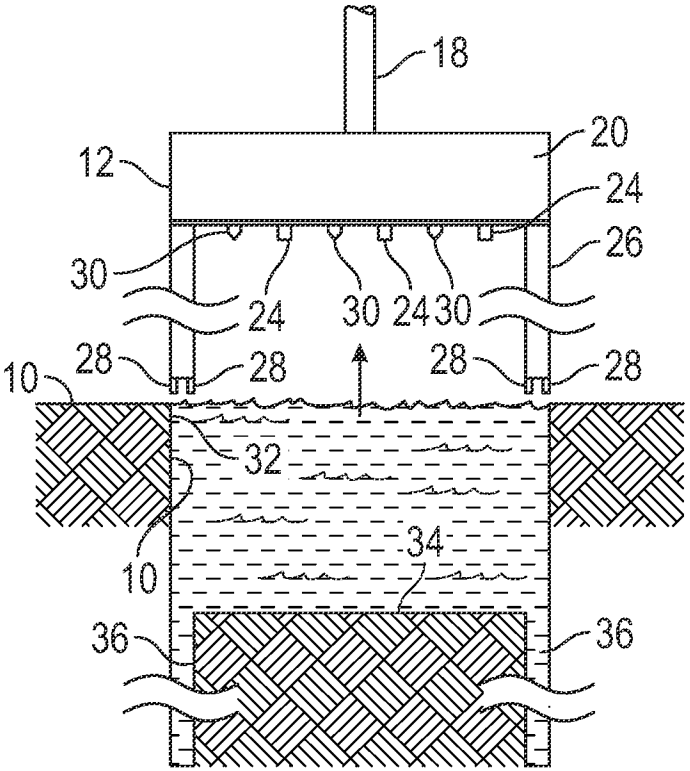
FIG. 2 is a schematic view showing the reamer tool removed from the ground after the hole is formed.
Figure 1:
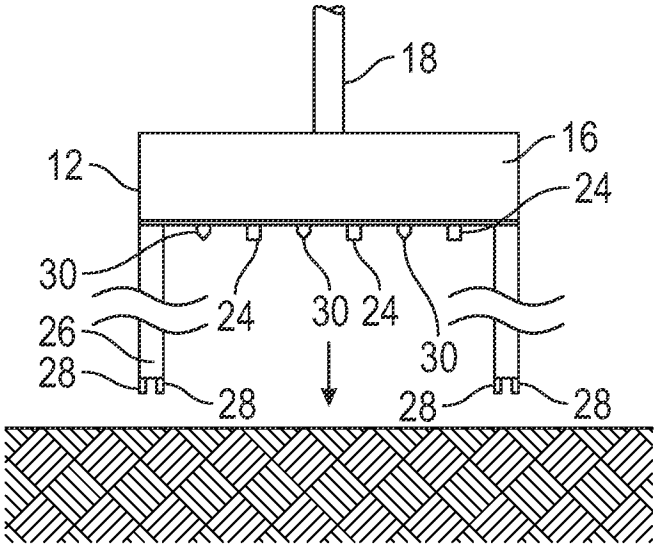
FIG. 1 is a schematic view showing the reamer tool positioned above the ground in preparation for excavation.

The method of the present invention for forming a hole or pit 10 in the ground is illustrated in FIGS. 1-4. The equipment used to form and maintain the hole 10 is shown in FIGS. 5-8. The equipment includes a reaming tool 12 and a shoring tool 14.

The reaming tool 12 includes a drill head 16 connected to a shaft 18. The head 16 includes an outer perimeter ring 20 with cross bars or braces 22 extending across the ring 20. A plurality of cutting tips 24 made of carbide or other hard material is provided on the bottom surface of the head 16, such as on the cross bars 22. A plurality of legs 26 extend downwardly from the perimeter of the ring 20 and have cutting tips 28 on the bottom of the legs. Alternatively, the perimeter 20 of the reamer head can extend below the cross bars 22, without the legs 26, such that the cutting tips 28 reside below the cutting tips 24.

The shaft 18 is adapted to be connected to a machine to rotate and drive the head 16 downwardly into the soil so that the cutters 24, 28 grind the soil. Fluid nozzles or ports 30 are provided on the head 16 to deliver water or other cutting fluid to the soil as the head 16 is rotated, so as to create a slurry with the ground soil. The nozzles 30 can be mounted on the head 16 at any convenient location, such as on the braces 22, and connected to an above-ground fluid source. The nozzles 30 are connected by one or more hoses extending through or along the shaft 18 to a fluid source above the ground. As the head 16 is forced downwardly, and the soil is ground by the cutters 24, 28, the slurry helps maintain the sidewall 32 of the hole 10. The cutters 24 form a floor 35 of the hole 10 at a desired depth. The cutters 28 form a deepened channel or perimeter edge 36 around the floor 34 adjacent to sidewall 32 of the hole 10. After the hole 10 reaches the desired depth, the reaming tool 12 is removed, so that the shoring tool 14 can be inserted into the hole 10.

In the preferred embodiment, the shoring tool 14 includes an inner wall 38 and an outer wall 40, which preferably are arranged concentric to another so as to form a gap 42 between the walls 38, 40. A plurality of tubes 44 extend within the gap or space 42 between the upper and lower ends of the walls 38, 40. Preferably, the tubes 44 extend vertically. The tubes 44 are open at their upper and lower ends. The upper ends of the tubes 44 are adapted to be connected to hoses of a dewatering machine, using any convenient coupling means, such as threads, or quick coupler attachment. The dewatering machine is conventional.

In an alternative embodiment, the shoring ring can have a single wall to engage the sidewall of the hole, with the vertical tubes attached or mounted on the inside surface of the single wall.

Figure 4:
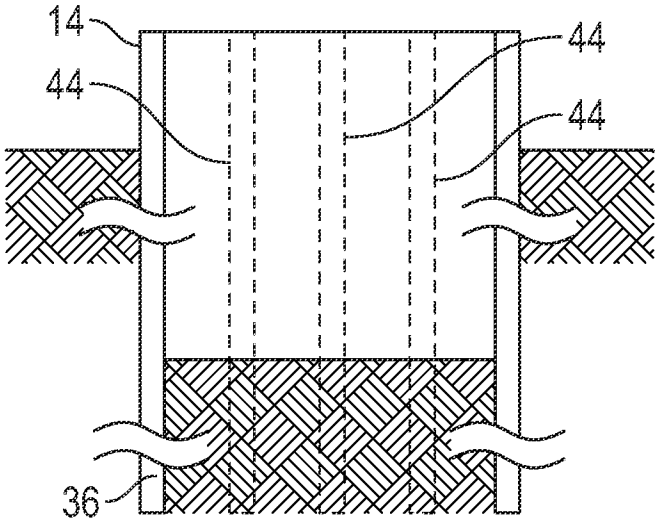
FIG. 4 is a schematic view showing the shoring ring installed in the excavated hole.
Figure 3:
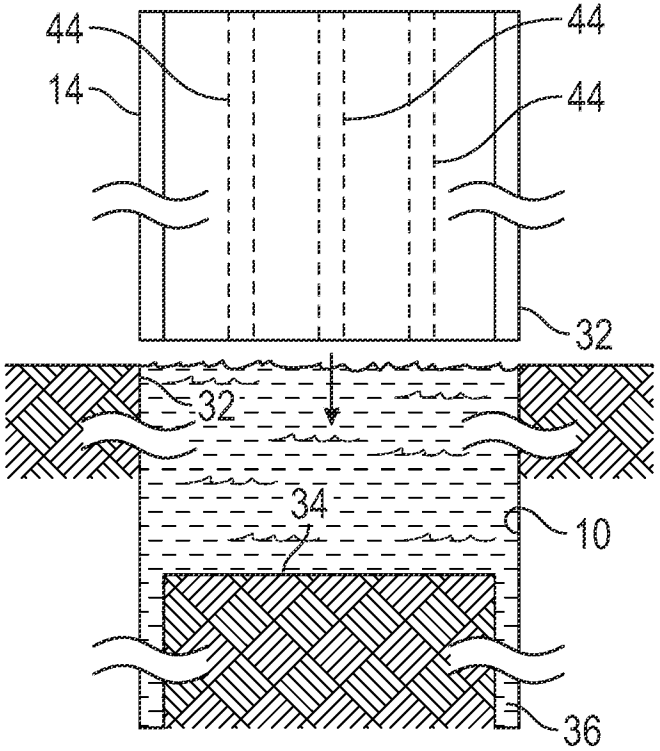
FIG. 3 is a schematic view showing the shoring ring positioned above the hole, prior to installation of the ring.
Figure 5:
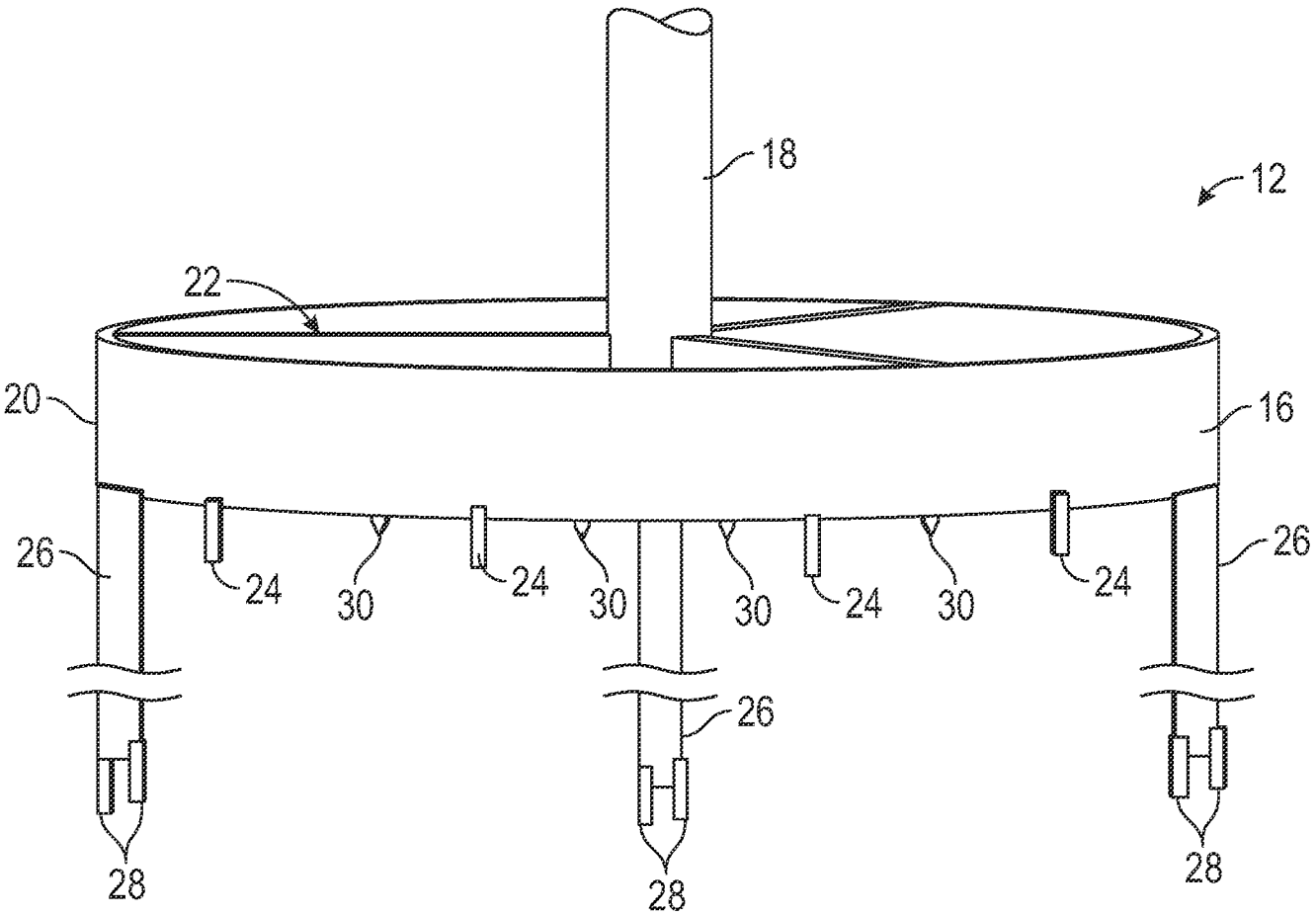
FIG. 5 is a perspective view of the reamer tool of the present invention.
Figure 6:
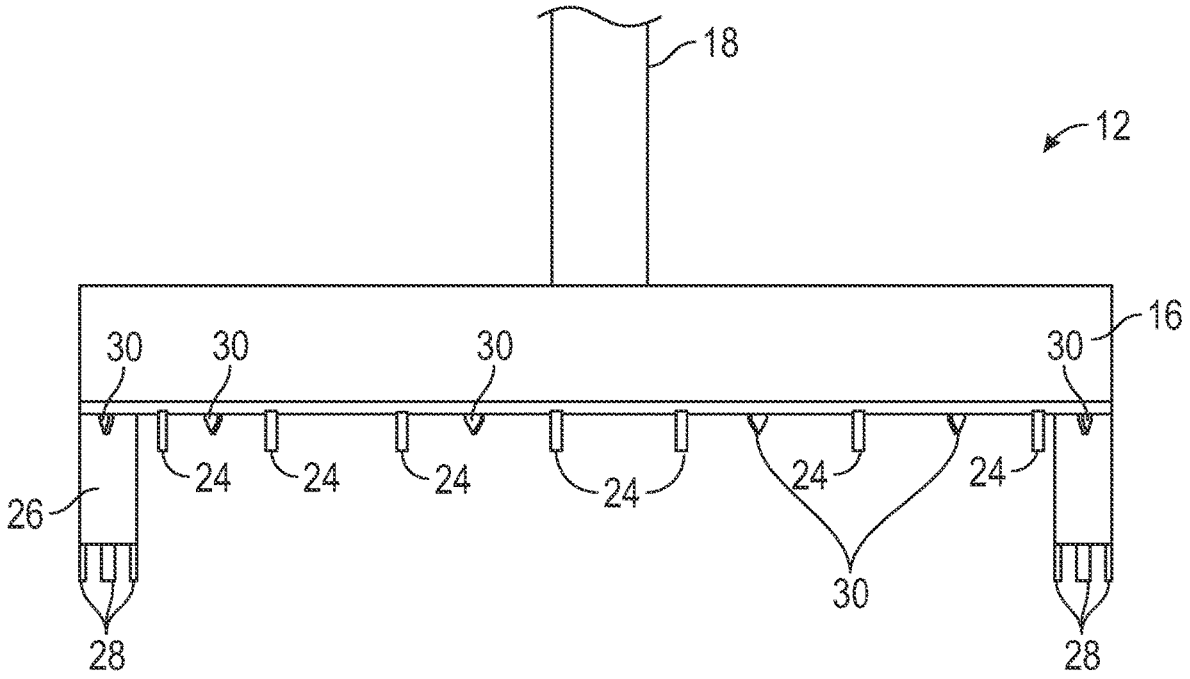
FIG. 6 is a side elevation view of the reamer tool.
Figure 8:
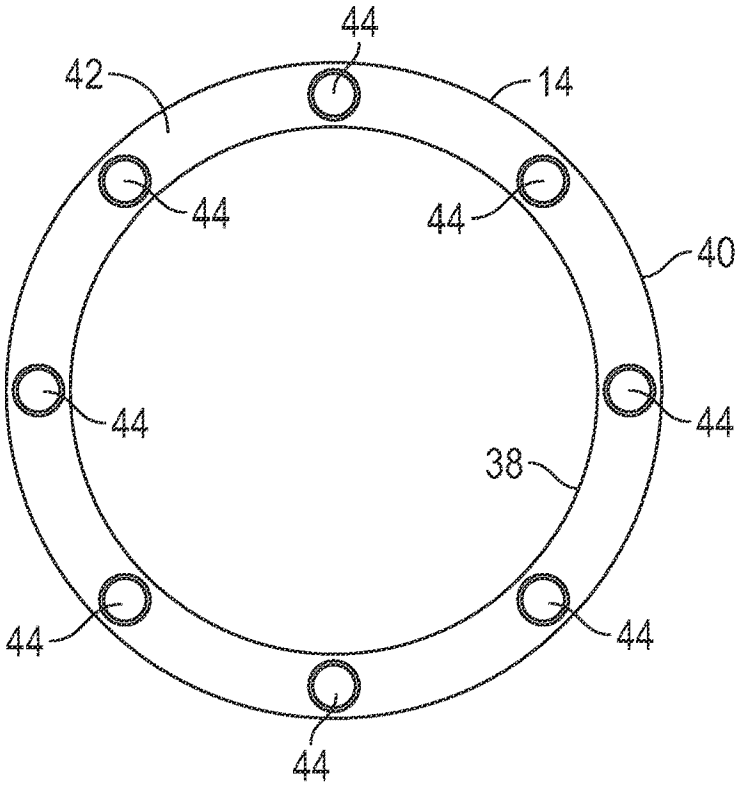
FIG. 8 is a top plane view of the shoring ring shown in FIG. 7.
Figure 7:
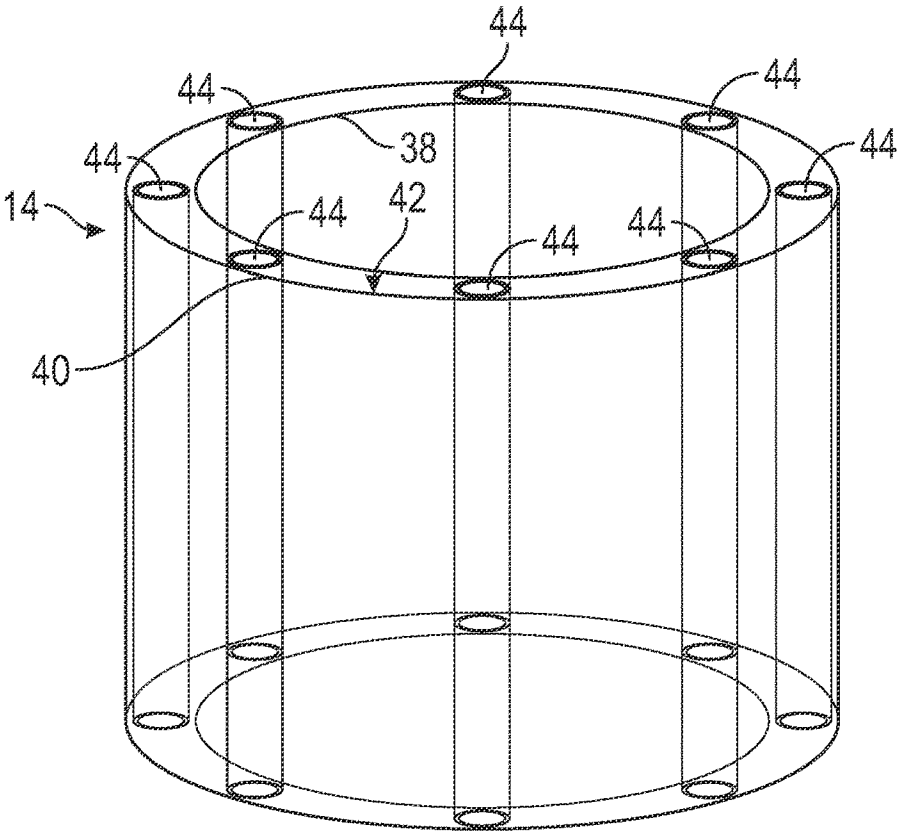
FIG. 7 is a perspective view of the shoring ring of the present invention.

After the hole 10 is formed and the reaming tool 12 is removed, the shoring tool or ring 14 can be forced downwardly through the slurry in the hole 10 until the bottom edge of the walls 38, 40 is seated in the bottom of the channel 36. The upper end of the walls 38, 40 may extend above the surrounding surface of the ground, as seen in FIG. 4. Thus, the shoring tool 14 will retain the sidewall 32 of the hole 10 and prevent cave-in of soil into the hole. After the shoring tool 14 is installed, the slurry material can be vacuumed or removed by other means from the hole, and the dewatering machine can be connected to the tubes 44 to remove additional water seeping from the soil into the hole 10.

Thus, the hole can be formed and maintained in a relatively dry condition so that workers and equipment can be lowered into the hole for whatever work is being performed. By extending the shoring ring 14 beyond the floor 34 of the hole 10, the shoring ring helps seal the flow of water onto the floor 34.

The "invention" is not intended to refer to any single embodiment of the particular invention but encompass all possible embodiments as described in the specification and the claims. The "scope" of the present disclosure is defined by the appended claims, along with the full scope of equivalents to which such claims are entitled. The scope of the disclosure is further qualified as including any possible modification to any of the aspects and/or embodiments disclosed herein which would result in other embodiments, combinations, subcombinations, or the like that would be obvious to those skilled in the art.

What is claimed is:

1. A shoring member for an excavated hole in the ground, comprising:

a wall with upper and lower ends;

a plurality of tubes extending vertically along the wall and adapted to connect to a dewatering machine for removal of water from the hole; and the wall is hollow and includes spaced apart inner and outer walls, and the tubes reside at spaced intervals between the inner and outer walls to provide structural stability along the wall;

the tubes each have a tubular wall, wherein the tubular walls of the tubes and the inner and outer walls of the wall do not share a common wall; and the tubes being formed independently of the wall.

2. The shoring member of claim 1 wherein the hole has a diameter and the ring has a diameter substantially equal to the hole diameter.

3. The shoring member of claim 1 wherein the wall has a height at least equal to a depth of the hole.

4. The shoring member of claim 1 wherein the tubes are open at upper and lower ends.

5. The shoring member of claim 1 wherein the wall is a ring.

6. The shoring member of claim 1 wherein the hole has a wall and the wall of the shoring member is shaped to match the wall of the hole.

7. The shoring member of claim 1 wherein the shoring member is sized to matingly fit into the hole.

8. A shoring member to retain a soil wall resulting from a ground excavation or drilling, comprising:

a rigid hollow wall configured to engage the soil wall;

a plurality of dewatering tubes fixed inside the rigid hollow wall at spaced distances from one another to provide structural strength along the wall, and adapted for connection to a dewatering machine, and wherein the tubes and the wall are free from a common wall defining the tubes.

9. The shoring member of claim 8 wherein the rigid hollow wall has upper and lower ends, and the dewatering tubes extend from the lower end to the upper end.

10. The shoring member of claim 8 wherein the dewatering tubes extend substantially vertically in the rigid hollow wall.

11. The shoring member of claim 8 wherein the rigid hollow wall has a circular shape.

12. The shoring member of claim 11 wherein the rigid hollow wall has an outer diameter matching a diameter of the soil hole formed by the excavation or drilling.

13. The shoring member of claim 8 wherein the rigid hollow wall has a height substantially matching a depth of the excavation or drilling hole.

14. The shoring member of claim 8 wherein the dewatering tubes each have an open lower end and an upper end adapted to be connected to the dewatering machine.

* * * * *